United States Patent [19]

Rodriguez

[11] Patent Number: 5,016,774

[45] Date of Patent: May 21, 1991

[54] PAINT CONTAINER CLOSURE CAP

[76] Inventor: Frank W. Rodriguez, 109 E. Lang St., Hanford, Calif. 93230

[21] Appl. No.: 554,565

[22] Filed: Jul. 19, 1990

[51] Int. Cl.[5] ..... B65D 51/18

[52] U.S. Cl. ..... 220/254; 150/154

[58] Field of Search ..... 220/254, 287; 150/154

[56] References Cited

U.S. PATENT DOCUMENTS

| | | | |
|---|---|---|---|
| 2,080,108 | 5/1937 | Brandstein | 220/287 X |
| 2,591,482 | 4/1952 | Weltlich | 220/287 X |
| 4,901,881 | 2/1990 | McElroy | 220/287 |
| 4,948,009 | 8/1990 | Sawatani | 220/229 |
| 4,949,865 | 8/1990 | Turner | 220/90.4 |

*Primary Examiner*—Stephen P. Garbe
*Assistant Examiner*—Nova Stucker
*Attorney, Agent, or Firm*—Leon Gilden

[57] ABSTRACT

A closure cap as set forth including a disk-shaped fabric web surrounded by a downwardly pending skirt wherein the skirt includes an encircling elastomeric ring to secure the web about as associated underlying paint container to maintain freshness of the paint contained therewithin between a series of uses thereof. The skirt is partially retracted in use to provide an opening to permit directing of a paint spray hose or an extension paint rod therethrough a prevent contamination of the paint during use by various debris. The invention further includes an enclosed opening directed through the web and optionally includes a cover flap wherein the cover flap is selectively securable overlying the opening wherein the opening may further include a rigid annular scraper edge mounted to an interior edge portion of the opening to permit scraping of excess paint relative to a hose or rod directed through the opening.

6 Claims, 4 Drawing Sheets

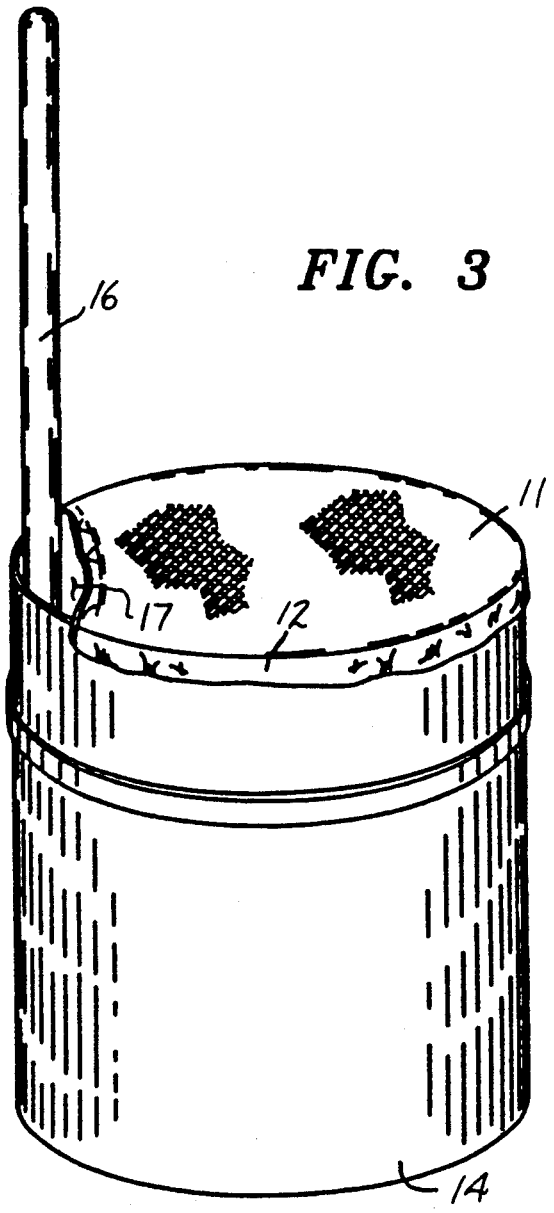
FIG. 3
FIG. 4
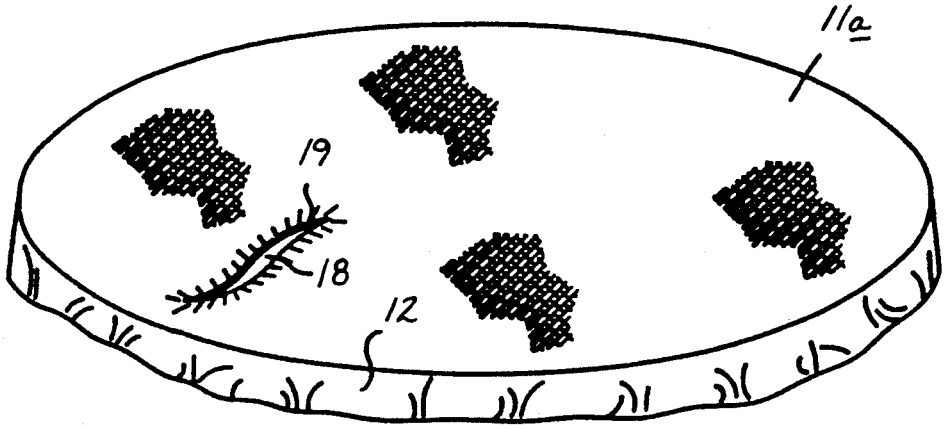

PAINT CONTAINER CLOSURE CAP

BACKGROUND OF THE INVENTION

1. Field of the invention

The field of the invention relates to painting apparatus, and more particularly pertains to a new and improved paint container closure cap wherein the same provides selective closure overlying a paint can to maintain freshness of the paint therewithin and prevent contamination of the paint be foreign matter during use and storage of the paint.

2. Description of the Prior Art

During a painting organization, an individual is typically required to maintain an open paint can wherein the open paint can is subject to contamination of the paint by various debris and the like such as dust, construction particles that may enter the paint during use. The organization of the instant invention attempts to overcome deficiencies of the prior art by providing a selectively securable overlying flexible web member that is secured over the paint can to provide selective opening of the paint can for projection of various painting paraphernalia to be directed therewithin. Examples of the prior art include U.S. Pat. No. 4,322,014 to PHILIP wherein a splash proof container includes a cover with a spout and associated baffle for the consuming of beverage contained within the container.

U.S. Pat. No. 3,356,266 to PINTER, JR. sets forth a lid member for securement to a container to provide a scraper lip formed about the container for effecting a scrapping operation during use of paint within the container.

U.S. Pat. No. 4,225,064 to WESTCOTT sets forth a painter accessory cap wherein the cap includes a fixed annular member for securement to a paint container wherein the member includes a scraper edge mounted through the opening of the organization.

U.S. Pat. No. 4,369,890 to BENNETT sets forth a paint can collar for securement to a paint can to minimize dripping and the like of paint directed from the container.

U.S. Pat. No. 4,813,579 to CIUMAGA sets forth a disposable paint can pouring spout which effects a snap fit onto a typical paint can rim to permit selective pouring of paint from the container without unnecessary dripping and spillage thereof.

As such, it may be appreciated that there continues to be a need for a new and improved paint container closure cap as set forth by the instant invention which addresses both the problems of ease of use as well as effectiveness in construction maintaining integrity and freshness of paint contained within an associated paint container utilizing the closure cap and in this respect, the present invention substantially fulfills this need.

SUMMARY OF THE INVENTION

In view of the foregoing disadvantages inherent in the known types of paint container closure cap structures present in the prior art, the present invention provides a new and improved paint container closure cap wherein the same permits selective securement overlying a paint can and of flexible construction to accommodate various paint can openings. As such, the general purpose of the present invention, which will be described subsequently in greater detail, is to provide a new and improved paint container closure cap which has all the advantages of the prior art paint container closure cap organizations and none of the disadvantages.

To attain this, the paint container closure cap of the instant invention includes a closure cap as set forth including a disk-shaped fabric web surrounded by a downwardly pending skirt wherein the skirt includes an encircling elastomeric ring to secure the web about an associated underlying paint container to maintain freshness of the paint contained therewithin between a series of uses thereof. The skirt is partially retracted in use to provide an opening to permit directing of a paint spray hose or an extension paint rod therethrough to prevent contamination of the paint during use by various debris. The invention further includes an enclosed opening directed through the web and optionally includes a cover flap wherein the cover flap is selectively securable overlying the opening wherein the opening may further include a rigid annular scraper edge mounted to an interior edge portion of the opening to permit scraping of excess paint relative to a hose or rod directed through the opening.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved paint container closure cap which has all the advantages of the prior art paint container closure caps and none of the disadvantages.

It is another object of the present invention to provide a new and improved paint container closure cap which may be easily and efficiently manufactured and marketed.

It is a further object of the present invention to provide a new and improved paint container closure cap which is of a durable and reliable construction.

An even further object of the present invention is to provide a new and improved paint container closure cap which is susceptible of a low cost of manufacture with regard to both materials and labor, and which accordingly is then susceptible of low prices of sale to the consuming public, thereby making such paint container closure cap economically available to the buying public.

Still yet another object of the present invention is to provide a new and improved paint container closure cap which provides in the apparatuses and methods of the prior art some of the advantages thereof, while simultaneously overcoming some of the disadvantages normally associated therewith.

Still another object of the present invention is to provide a new and improved paint container closure cap which may be compactly stored when not being utilized.

Yet another object of the present invention is to provide a new and improved paint container closure cap wherein the same provides selective overlying closure of an associated paint container permitting selective access into the paint container to maintain freshness and prevent contamination of the paint therewithin from foreign matter such as debris.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to .the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 3 is an isometric illustration of the instant invention in association with a painting extension rod utilized.

FIG. 4 is an isometric illustration of a modified closure cap of the instant invention.

DESCRIPTION OF THE PREFERRED EMBODIMENT

Figure 1:
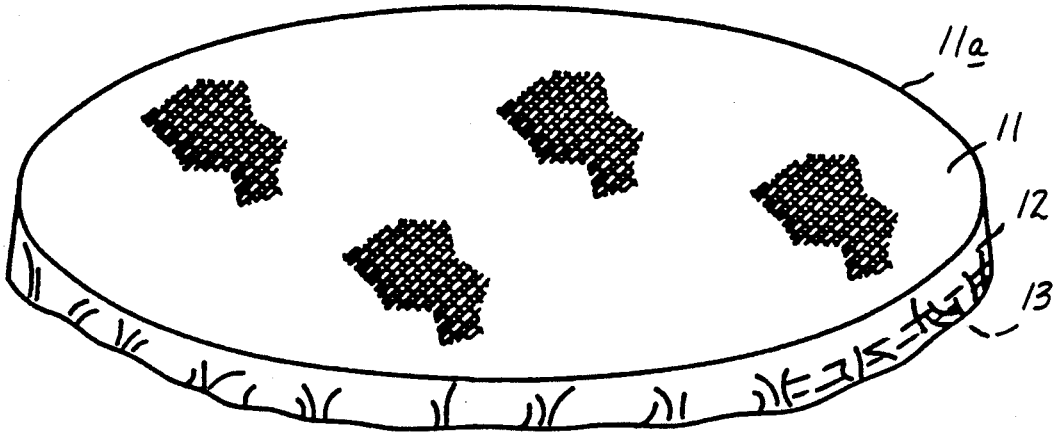
FIG. 1 is an isometric illustration of the closure cap utilized by the instant invention.

With reference now to the drawings, and in particular to FIGS. 1 to 8 thereof, a new and improved paint container closure cap embodying the principles and concepts of the present invention and generally designated by the reference numeral 10 will be described.

More specifically, the paint container closure cap 10 of the instant invention essentially comprises a disk-shaped flexible fabric web 11 surrounded at its periphery by a downwardly depending web skirt 12 arranged generally orthogonally relative to the web 11 by a continuous seam 11*a*. A continuous elastomeric ring 13 is mounted within the skirt 12 to bias the skirt 12 into a clamping arrangement about an associated upper end of a paint container 14. Such paint containers are typically utilized in commercial painting and are conventionally of a five gallon configuration although it is understood that the closure cap of the instant invention may be provided in a variety of sizes to accommodate a variety of paint cans in use. The fabric web 11 and associated skirt are formed of a fluid impermeable material to effect an air tight seal within the closure when the skirt 12 is in a circumferentially encompassing orientation about the upper end of the can 14. During storage of paint and the like within the container 14, air tight seal of the enclosure prevents curing of the paint therewithin as well as preventing debris from entering the can.

Figure 2:
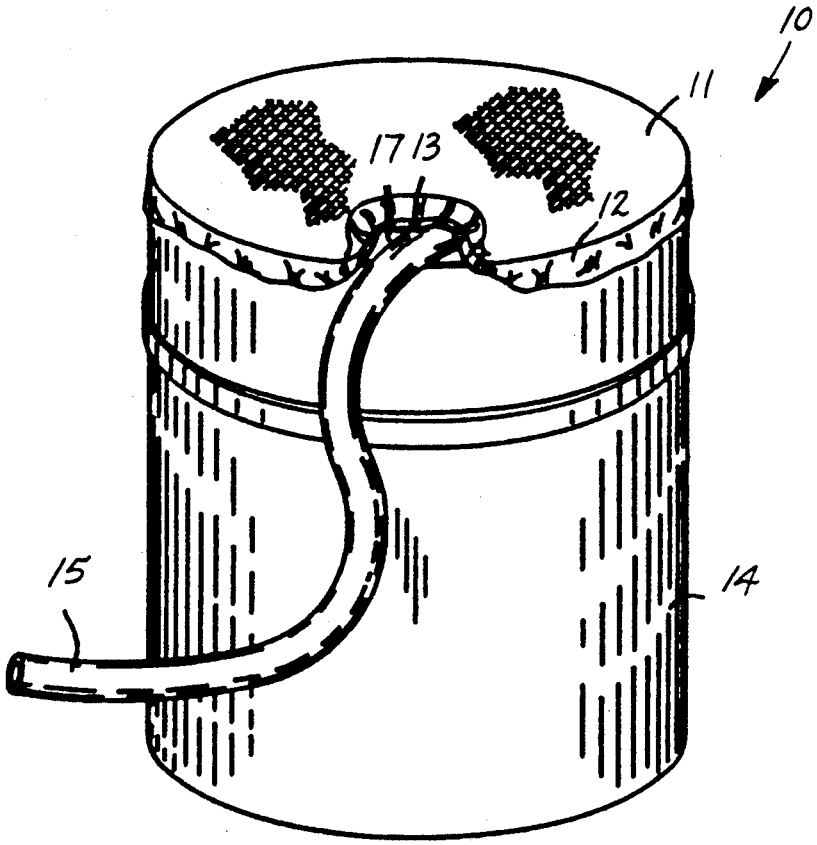
FIG. 2 is an isometric illustration of the closure cap utilized in securement to an associated paint can and paint hose contained within the paint can.

As illustrated in FIG. 2, a paint hose 15 is directed interiorly of the paint container 14 whereupon an opening 17 is defined between the skirt 12 and the upper end of the paint container 14 to permit access of the hose within the container but prevent debris from entering the container during use.

FIG. 3 illustrates the use of a paint extension rod 16 in leu of a hose 15 wherein such an extension rod is utilized with paint rollers and the like in painting operations.

FIG. 4 illustrates the use of a modified web 11*a* including an enclosed slit 18 defined by adjacent spaced elastomeric strips to effect biasing the strips together and maintain a normally closed orientation of the slit which may be separated for insertion of a hose and the like therewithin to gain access to contents within the container 14 without removal of the web or cap in use.

Figure 5:
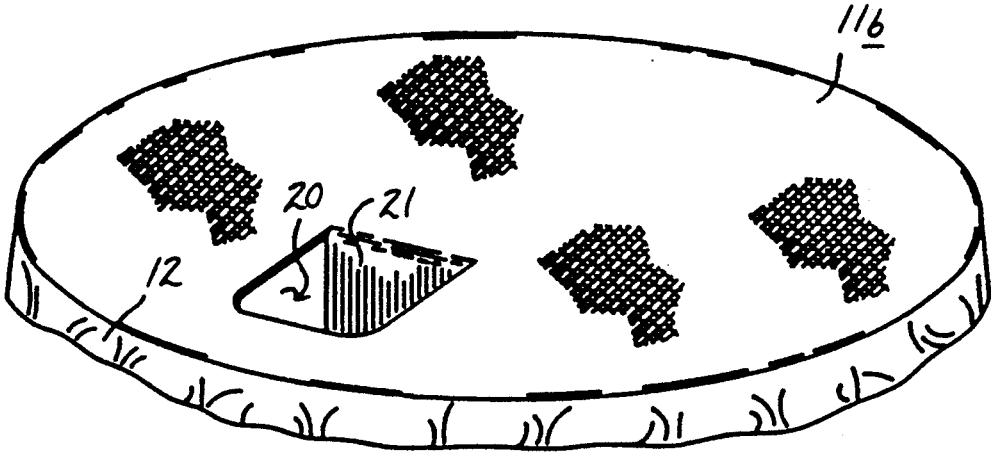
FIG. 5 is an isometric illustration of a further modified closure cap of the instant invention.
Figure 6:
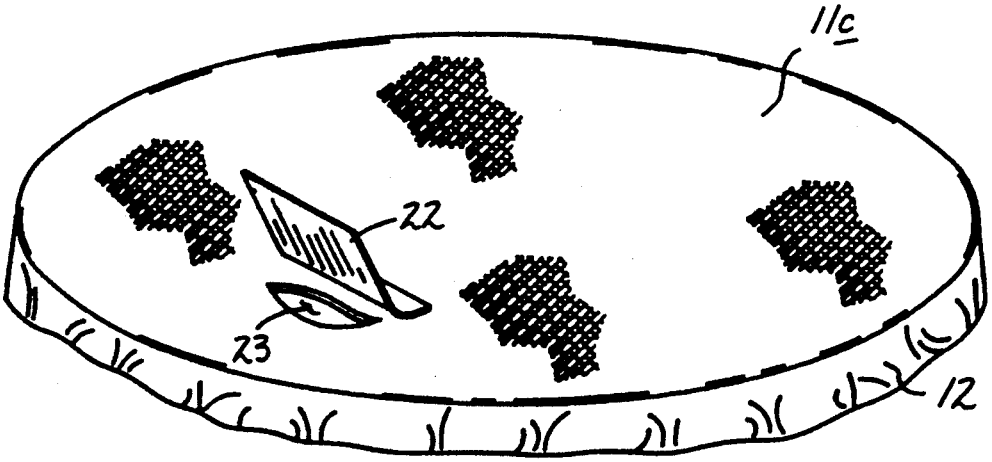
FIG. 6 is an isometric illustration of a yet further modified closure cap of the instant invention.
Figure 7:
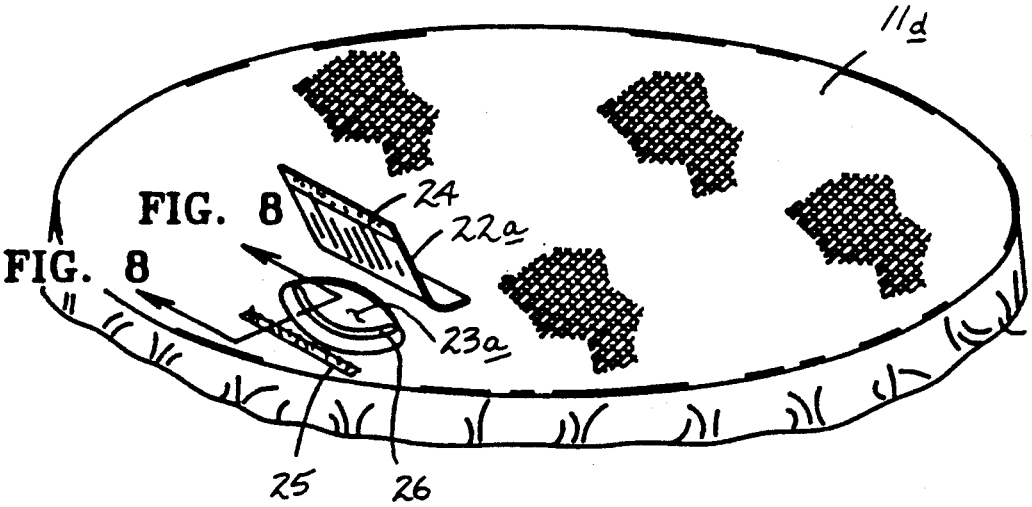
FIG. 7 is an isometric illustration of a still further modified closure cap of the instant invention.
Figure 8:
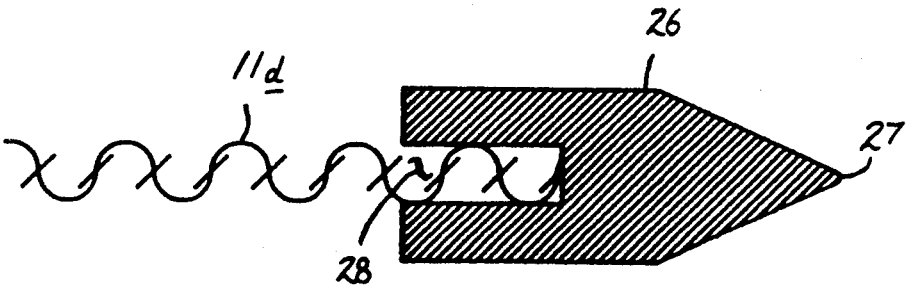
FIG. 8 is an orthographic view taken along the lines 8—8 of FIG. 7 in the direction indicated by the arrows.

FIG. 5 illustrates the use of an entrance flap 21 that is normally biased downwardly relative to a flap opening 20 wherein FIG. 6 illustrates the use of a cover flap 22 defined by a predetermined configuration and underlying enclosed slot 23 of a further predetermined configuration less than that of the predetermined configuration of the entrance flap 21. The cover flap 22 is fixedly mounted adjacent and coextensive with the enclosed slot 23 and is normally biased in a closed orientation to overlie the enclosed slot 23 and is lifted in a manner as illustrated in FIG. 6 to permit access of a paint hose and the like to be directed through the slot 23 for use. FIG. 7 illustrates the use of a modified cover flap 22*a* overlying a modified enclosed slot 23*a*. The modified flap 22*a* includes a first hook and loop fastener strip 24 mounted coextensively with a free end edge of the modified flap 22*a* to cooperate with a second hook and loop fastener strip 25 arranged generally parallel with the first hook and loop fastener strip 24 and cooperative therewith when the flap is in a first overlying position relative to the second hook and loop fastener strip 25 to provide securement of the flap 22 prior to use of the modified slot 23*a*. An arcuate rigid scraper edge member 26 is mounted and defines an elongate edge of the slot 23*a* to permit cleaning of a hose and the like and scraping of excess paint therefrom upon removal of the hose (such as the hose 15 as illustrated in FIG. 2) from the modified slot 23*a*. The scraped edge member 26 is formed with a forward arcuate edge 27 and a web receiving slot 28 directed through a rear end of the scraper edge member 26 to receive the web 11*d* therewithin and secure the web 11*d* into position within the scraper edge member 26 and maintain the scraper edge member 26 in position in relationship to the modified slot 23*a*.

As to the manner of usage and operation of the instant invention, the same should be apparent from the above disclosure and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. A paint container closure cap in combination with a container wherein the container includes an open upper end and wherein the paint closure cap includes a disk-shaped flexible fabric web to overly the open upper end, the disk-shaped flexible fabric web having an elongate opening defining a slot the closure cap further including a skirt downwardly depending from the periphery of the disk-shaped flexible fabric web and the skirt including a continuous elastomeric ring mounted continuously within the skirt to effect securement of the skirt relative to the open upper end.

2. A paint container closure cap as set forth in claim 1 including a cover flap mounted adjacent to the slot to overly the slot in a first position and displaceable from the slot to provide access to the slot in a second position.

3. A paint container closure cap as set forth in claim 2 wherein the fabric web is formed of a fluid impermeable material.

4. A paint container closure cap as set forth in claim 3 wherein the cover flap includes a first hook and loop fastener strip mounted coextensively with a free end edge of the cover flap, and a rear end edge of the cover flap fixedly mounted to the web.

5. A paint container closure cap as set forth in claim 4 including a second hook and loop fastener strip arranged parallel to the first hook and loop fastener strip and fixedly mounted adjacent the slot for securement with a first hook and loop fastener strip in the first position.

6. A paint container closure cap as set forth in claim 5 wherein the slot includes a rigid arcuate scraper edge member mounted within the slot defining an elongate edge thereof wherein the scraper edge member includes a forward arcuate edge and a web receiving slot arranged rearwardly of the scraper edge member to receive the web therewithin to secure the scraper edge member within the slot.

* * * * *